United States Patent [19]

Bihlmaier

[11] Patent Number: 5,012,853

[45] Date of Patent: May 7, 1991

[54] PROCESS FOR MAKING ARTICLES WITH SMOOTH COMPLEX INTERNAL GEOMETRIES

[75] Inventor: John A. Bihlmaier, Marengo, Ill.

[73] Assignee: Sundstrand Corporation, Rockford, Ill.

[21] Appl. No.: 246,620

[22] Filed: Sep. 20, 1988

[51] Int. Cl.[5] ..... B22D 19/00

[52] U.S. Cl. ..... 164/75; 164/98; 164/132; 29/889; 29/890.142

[58] Field of Search ..... 164/75, 98, 100, 101, 164/131, 132, 138; 29/157 C, 889, 890.142

[56] References Cited

U.S. PATENT DOCUMENTS

| | | | |
|---|---|---|---|
| 3,072,983 | 1/1963 | Brenner et al. | 164/132 |
| 3,416,591 | 12/1968 | Babel et al. | 164/465 |
| 3,427,698 | 2/1969 | Guzewicz | 29/157 C |
| 3,840,185 | 10/1974 | Ruthardt | 29/157 C |
| 3,920,064 | 11/1975 | Yakovlevich et al. | 164/421 |
| 3,921,701 | 11/1975 | Cordone | 164/98 |
| 3,945,423 | 3/1976 | Hannig | 164/98 |
| 3,948,309 | 4/1976 | Cordone et al. | 164/98 |
| 4,043,377 | 8/1977 | Mazdiyasni | 164/132 |
| 4,108,931 | 8/1978 | Ogden | 264/37 |
| 4,137,619 | 2/1979 | Beltran et al. | 29/156.8 H |
| 4,185,369 | 1/1980 | Darrow et al. | 416/92 |
| 4,370,789 | 2/1983 | Schilke et al. | 29/156.8 H |
| 4,447,466 | 5/1984 | Jackson et al. | 164/46 |
| 4,532,974 | 8/1985 | Mills et al. | 164/132 |
| 4,559,687 | 12/1985 | Tsunoi et al. | 29/157 C |
| 4,569,384 | 2/1986 | Mills | 164/131 |
| 4,574,451 | 3/1986 | Smashey et al. | 164/34 |
| 4,603,568 | 8/1986 | Siemers et al. | 72/47 |
| 4,642,863 | 2/1987 | Schulz | 29/156.8 H |
| 4,712,605 | 12/1987 | Sasaski et al. | 164/34 |

FOREIGN PATENT DOCUMENTS

| | | | |
|---|---|---|---|
| 25481 | 3/1981 | European Pat. Off. | 164/132 |
| 190114 | 8/1986 | European Pat. Off. | 164/98 |
| 2404115 | 10/1974 | Fed. Rep. of Germany | 164/98 |
| 242014 | 1/1987 | Fed. Rep. of Germany | 164/98 |
| 15125 | 5/1970 | Japan | 29/157 C |
| 23327 | 3/1975 | Japan | 164/132 |
| 4047 | 2/1978 | Japan | 164/132 |
| 11816 | 2/1978 | Japan | 164/132 |
| 29972 | 9/1979 | Japan | 164/98 |
| 36037 | 2/1982 | Japan | 164/98 |
| 169659 | 9/1984 | Japan | 164/132 |
| 1021880 | 3/1966 | United Kingdom | 29/157 C |

*Primary Examiner*—Richard K. Seidel
*Assistant Examiner*—Edward A. Brown
*Attorney, Agent, or Firm*—Antonelli, Terry, Stout & Kraus

[57] ABSTRACT

An improved process for forming objects such as turbine nozzles (10) with internal geometries without requiring machining of the internal geometry to produce a smooth complex internal surface (16, 18 and 19) is disclosed. The process includes forming a mandrel (30) containing a negative image of the internal geometry; coating the mandrel with a material (32) which is not chemically reactive with the material from which the mandrel is formed, capturing the mandrel in a mold or form (34) which is to receive the material from which the object is to be formed, the material (36) from which the object is to be made not being chemically reactive with the coating; filling the mold or form with the material to capture the mandrel and coating in solidified material contained in the form; and removing the form and the mandrel. If the material is a cast metal, the melting point of the material for forming the object should be below the melting point of the coating on the mandrel.

30 Claims, 2 Drawing Sheets

PROCESS FOR MAKING ARTICLES WITH SMOOTH COMPLEX INTERNAL GEOMETRIES

TECHNICAL FIELD

The present invention relates to processes for making articles having smooth complex internal geometries without requiring machining. More particularly, the present invention relates to processes for forming turbine nozzles having complex internal contours resulting in low flow resistance.

BACKGROUND ART

The state of the art of turbine nozzle design has reached a plateau regarding the manufacturing of internal geometries having complex shapes. Internal geometries for turbine nozzles which have compound internal curves are not readily machinable by conventional machining processes at a reasonable expense which permits implementation.

EDM (electrical discharge machining) and ECM (electrical chemical machining) are now in use for the manufacture of turbine nozzles. EDM has a high cost and requires post machining processes to achieve smooth finishes. The EDM process creates a "recast layer" which requires grinding and polishing for proper surface finish. Moreover, EDM, as well as all available machining processes to date, are limited in producing a repeatable internal geometry. EDM is also limited as to the types of internal geometry and depth of cut.

It is desired for the internal geometries of turbine nozzles to have a smooth mirror-like finish to minimize flow resistance on gases flowing through the nozzle. Accordingly, for turbine nozzles having complex internal geometries there is a need for a process which permits smooth mirror-like finishes to be obtained on the surfaces of the internal geometries without requiring machining or other processing steps.

A process known as investment casting is in wide use in lower technological applications. With investment casting, the mold in which a product is to be cast is produced by surrounding an expendable pattern with a refractory material that sets at room temperature. The pattern, which conventionally is in the form of wax or plastic material, is then melted or burned out of the mold, leaving the mold cavity that receives the hot metal from which the final product is formed. After the cast metal is cooled, the mold is broken away from the product. For example, see U.S. Pat. No. 4,108,931. However, the process of investment casting is not usable for making turbine nozzles with complex internal geometries which have a mirror finish without machining or other post-casting operations to obtain the desired refractory finish.

DISCLOSURE OF INVENTION

The present invention provides a process which permits the manufacturing of formed objects having complex internal geometries in which the surfaces of the internal geometries have a smooth finish which does not require post forming operations such as machining or polishing to achieve the smooth finish. In a preferred form of the invention, the process is utilized for forming the internal geometries of turbine nozzles with complex curves which it has not been previously physically possible or economically feasible to produce a commercially acceptable product with the prior art processes. With the invention, the turbine nozzle is formed by powder metallurgy or casting with a molten metal which captures a mandrel that has been coated with a nonferrous metallic material which is not chemically reactive with the material used for forming the nozzle. Thereafter, the mandrel is removed to expose the coating as the smooth surface of the internal geometry. The process by which the coating is deposited on the mandrel produces a smooth internal finish on the surface of the mandrel which does not require machining of the turbine nozzle internal geometry after the mandrel is removed. Furthermore, because the metallic material from which the turbine nozzle is formed is not chemically reactive with the metallic coating on the mandrel, the internal geometry of the turbine nozzle will have a smooth finish not requiring machining.

The mandrel may be formed by any conventional process to produce a shape which is a negative (mirror) image of the desired internal geometry. Preferably, the mandrel should be made from a material having a compressive strength which is compatible with the compressive forces consequent from cooling of the casting material or powder metallurgical material surrounding the mandrel to prevent damage to the mandrel which ensures that the desired smooth finish of the internal geometry is achieved.

A process for making castings with internal geometries without requiring machining of the internal geometry to produce a smooth internal surface comprises forming a mandrel containing a negative image of the internal geometry; coating the mandrel with a nonferrous material which is not chemically reactive with the material from which the mandrel is formed; capturing the mandrel in a mold which is to receive a molten metal from which the casting is to be cast, the molten metal from which the casting is to be made not being chemically reactive with the coating; filling the mold with molten casting metal to capture the mandrel and coating in solidified casting metal contained in the mold; and removing the mold and the mandrel. Preferably the coating material is metallic. The mandrel is made from a material which is compatible with the compressive force upon cooling of the casting metal contained within the mold. The mandrel may be made from carbon, ceramics (oxides, silicon carbide, silicon nitride), ceramic composites, and soluble ceramics. The coating on the mandrel may be chosen from a noble metal such as gold, silver, platinum, palladium, iridium, rhodium, as well as columbium/niobium, tantalum, chromium, rhenium, tungsten, and molybdenum and the molten casting metal may be chosen from stainless steels, nickel base alloys (inconel, hastelloy, superalloys, cobalt based alloys and aluminides (nickel and titanium). Preferably, the coating of the mandrel is performed by electroplating the mandrel but other coating processes such as CVD (Chemical Vapor Deposition), PVD (Physical Vapor Deposition) and Thermal Spray Deposition may be employed.

A process for making formed objects with internal geometries without requiring machining of the internal geometry to produce a smooth internal surface comprises forming a mandrel containing a negative image of the internal geometry; coating the mandrel with a material which is not chemically reactive with the material from which the mandrel is formed; capturing the mandrel in a form which is to receive a material from which the object is to be formed, the material from which the object is to be formed not being chemically reactive with the metallic coating; filling the form with the material from which the object is to be made and processing the material to capture the mandrel and coating in the material contained in the form; and removing the form and mandrel. Preferably, the coating material is metallic. The mandrel is made from a material which is compatible with the compressive force upon processing of the material contained within the form. The mandrel may be made from machined carbon, ceramics (oxides, silicon carbine, silicon nitride) ceramic composites and soluble ceramics. The coating on the mandrel may be a noble metal such as gold, silver, platinum, palladium, iridium, rhodium, as well as rhenium, columbium/niobium, tantalum, chromium, tungsten, and molybdenum and the material for forming the object may be formed by a powder metallurgical process, such as slip casting, hydrostatic pressure, vibratory filling or sintering. Preferably, the coating of the mandrel is performed by electroplating the mandrel but other coating processes such as aforementioned depositions may be used depending on the requirement.

BEST MODE FOR CARRYING OUT THE INVENTION

Figure 1:
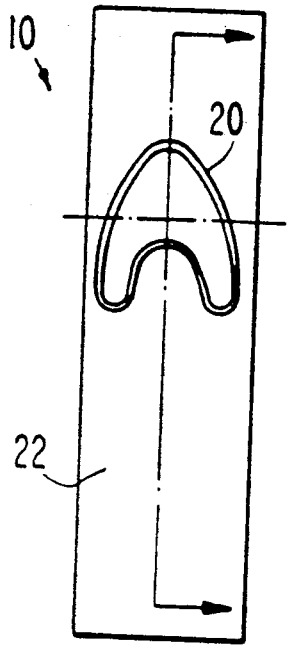
FIG. 1 is an end view of a discharge nozzle of a turbine made in accordance with the present invention.
Figure 2:
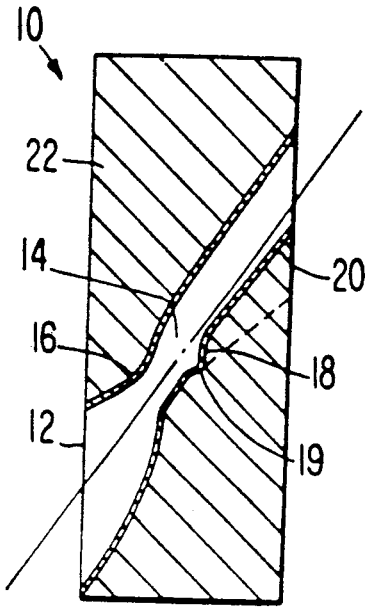
FIG. 2 is a sectional view of FIG. 1.

FIGS. 1 and 2 illustrate respectively an end view of a discharge nozzle 10 of a turbine nozzle and a sectional view thereof which has been formed by the process of the present invention. Like reference numerals identify like parts in FIGS. 1-2. The turbine nozzle 10 as illustrated has a complex internal geometry characterized by curved surfaces, as illustrated in FIG. 2. This type of nozzle would not be physically possible or economically feasible to machine in accordance with present processes for producing turbine nozzles. The gas flow path of the nozzle 10 has a gas inlet 12 which opens into a flow path 14 which contains a plurality of complex smooth polished curved surfaces 16, 18 and 19 which are not physically possible or economically feasible to machine by existing machining processes for making turbine nozzles. The gas flow path 14 is lined by metal 20 which is deposited by electroplating or other processes as described below. The metal is a metal which is non-reactive (chemically inert) with the material from which a mandrel is formed, as described below. The mandrel for forming the internal geometry of the object being formed is a negative image of the internal geometry 14. Furthermore, the metal 20 is non-reactive with the material 22 from which the turbine nozzle 10 is formed. The material 22 may be either cast or metal formed by conventional powder metallurgical processing. If the material 22 is cast metal, the melting temperature thereof should be lower than the melting temperature of the metallic layer 20. If the material 22 is formed by a powder metallurgical process, the object may be formed by slip casting hydrostatic pressure, vibratory filling or sintering. The layer 20 may be made from a noble metal such as gold, silver, platinum, palladium, iridium, rhodium, as well as any other metal which satisfies the above dual criteria of being non-reactive with both the material from which the mandrel, as described below, is made and the material 22 from which the turbine nozzle 10 is formed with it being necessary that the temperatures at which the material 22 is formed as described below are lower than the melting point of the metal liner. Other materials are rhenium, columbium/niobium, tantalum, chromium, tungsten, and molybdenum.

It should be understood that the turbine nozzle illustrated in FIGS. 1 and 2 is only exemplary of objects having complex smooth non-machinable internal geometries which may be formed by the present invention. Furthermore, the present invention may be used to form any object requiring complex internal surfaces with a smooth mirror-like finish which does not require machining to achieve the smooth finish.

Figure 3:
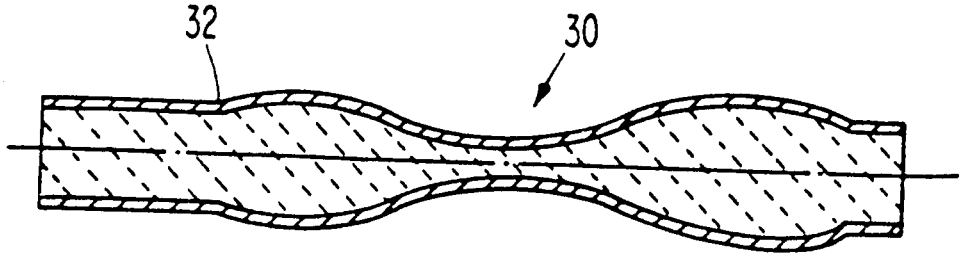
FIG. 3 is an example of a mandrel which may be used in practicing the present invention.

FIG. 3 illustrates a mandrel 30 used for forming an object having a complex smooth internal surface which may not be practically machined to achieve the smooth finish. The mandrel 30 is made from a material which is non-reactive with the metallic coating 32 which forms the interior surface of the object being formed. Either casting or powder metallurgy processes may be used to form the object. The mandrel may be made from any material which is readily formed into a smooth surface having complex curves by conventional processes such as machining or molding and which is removable from the formed object after the material used for forming the object has solidified by conventional processes such as dissolving with solutions or oxidation under an environment using controlled heat and oxygen. The mandrel 30 is placed in a conventional electroplating solution and coated with a layer of metal such as the metals identified above which is not reactive with either the material from which the mandrel is made or the material from which the object is formed. Alternatively, the mandrel may be coated by the alternative processes CVD, PVD and Spray Deposition. The coating 32 on the outer surface of the mandrel 30 preferably does not have a mirror-like finish so as to promote a mechanical bond with the casting or powder metallurgical material. While the invention is not limited to any particular thickness of coating, it has been found that a coating of a noble metal, such as platinum, of 0.003-0.005 inches is sufficient for some requirements, but others may need a much thicker coating. The interior surface of coating 32 has a smooth mirror-like finish which upon becoming the internal surface of the formed object as described below does not require any machining operations for complex internal geometries requiring extremely smooth finishes.

Figure 4:
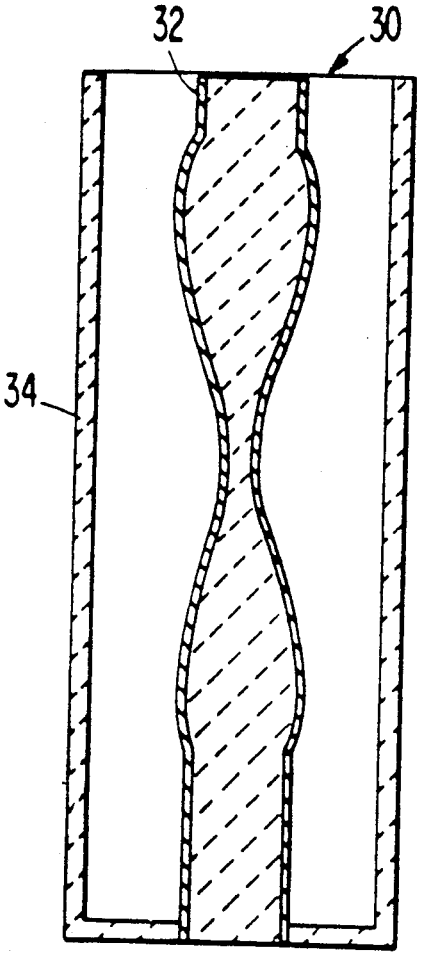
FIG. 4 illustrates the mandrel of FIG. 3 placed in a mold or form prior to filling the mold or form with material from which the object is to be formed.

FIG. 4 illustrates the placement of the mandrel 30 within an investment type mold 34 used for casting or form used for powder metallurgical processing of conventional construction. For use of the invention for casting, the mandrel is initially placed in a master die. Conventional materials, such as wax or styrofoam, are placed in the die to capture the mandrel. The die is removed and the assembly is coated with a slurry of conventional refractory material. The coated assembly is cured to provide the mold 34. For use of the invention for powder metallurgical processing the mandrel is placed in a form or die 34 which functions as a form of the powered metal to be placed therein. The present invention is not limited to any particular type of form or die or process for making the form.

Figure 5:
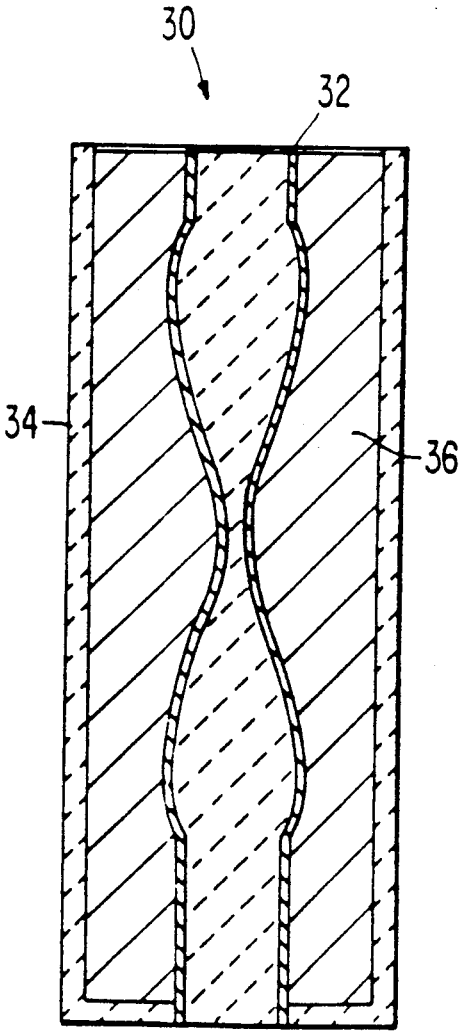
FIG. 5 is a view illustrating the mandrel disposed within the mold or form with the material from which the object is formed being within the form or mold.

FIG. 5 illustrates the formed object contained in the mold or form 34 which has been filled with material 36 which may be placed in the mold or form by powder metallurgical techniques or by casting of metals having the above-referenced properties of being nonreactive with the metallic coating 32 of the mandrel 30 and further having a melting point below the melting point of the coating 32.

After the material 36 has solidified or cured, the mold or form 34 is removed to expose the material 36. Thereafter, the mandrel 30 is removed by dissolving of the mandrel with a solution if the mandrel is made from soluble material or removing the mandrel such as, but not limited to, by a combination of heat and oxygen if the mandrel is made from a material such as carbon which is oxidizable.

It should be understood that the choice of metals used for coating the mandrel 30 and the materials used for forming the object by either powdered metallurgical techniques or casting should be chosen to match shrinkage of the various materials so that the metallic layer 32 does not delaminate from the mandrel which could cause surface finish problems. Furthermore, it should be noted that as a consequence of using high temperatures during the forming of the object that substantial shrinkage will occur around the mandrel 30 during cooling. Therefore, it is desirable to choose a material having a compatible compressive strength, such as, but not limited to, carbon so that the mandrel 30 is not damaged which could cause imperfections in the finish of the internal surface.

While the invention has been described in terms of its preferred embodiments, it should be understood that numerous modifications may be made thereto without departing from the spirit of the invention as defined in the appended claims. For example, the invention is not limited to any particular type of object to be formed with turbine nozzles having complex internal geometries being only exemplary of the applications of the invention. Furthermore, while the materials disclosed for making the coating of the mandrel and for making the object are those which are preferred in practicing the invention, it should be understood that other materials may be utilized in practicing the invention as long as they satisfy the overall criteria of not being reactive with the metallic coating on the mandrel to thereby provide a smooth interior surface on the coating which faces the mandrel. A matte surface between materials 32 and 36 is preferred for the mechanical bond. It is not necessary that the coating of the mandrel must be metallic. It is intended that all such modifications fall within the scope of the appended claims.

I claim:

1. A process for making a turbine nozzle having a gas flow path with an internal geometry without requiring machining of the internal geometry to produce a smooth internal surface comprising:

forming a mandrel containing a negative image of the internal geometry;

coating the mandrel with a nonferrous material which is not chemically reactive with the material from which the mandrel is formed;

capturing the mandrel in a mold which is to receive a molten metal from which the turbine nozzle is to be cast, the molten metal from which the turbine nozzle is to be cast not being chemically reactive with the coating and having a melting point below the melting point of the material of the coating;

filling the mold with molten casting metal to capture the mandrel and coating in solidified casting material contained in the mold; and removing the mold and the mandrel from the turbine nozzle while retaining the non-ferrous material as the gas flow path of the turbine nozzle.

2. A process in accordance with claim 1 wherein:

the coating on the mandrel is metallic.

3. A process for making castings in accordance with claim 2 wherein:

the mandrel is made from a material which withstands compressive force upon cooling of the metal contained within the mold without damaging the mandrel.

4. A process for making castings in accordance with claim 3 wherein:

the mandrel is made from carbon.

5. A process for making castings in accordance with claim 3 wherein:

the mandrel is made from a ceramic.

6. A process for making castings in accordance with claim 3 wherein:

the mandrel is made from a ceramic composite.

7. A process for making castings in accordance with claim 3 wherein:

the mandrel is made from a soluble ceramic.

8. A process for making castings in accordance with claim 4 wherein:

the mandrel is machined carbon.

9. A process for making castings in accordance with claim 2 wherein:

the coating of the mandrel is placed by electroplating the mandrel.

10. A process for making castings in accordance with claim 2 wherein:

the coating of the mandrel is placed by chemical vapor deposition.

11. A process for making castings in accordance with claim 2 wherein:

the coating of the mandrel is placed by physical vapor deposition.

12. A process for making castings in accordance with claim 2 wherein:

the coating of the mandrel is placed by thermal spray deposition.

13. A process for making a turbine nozzle having a gas flow path with an internal geometry without requiring machining of the internal geometry to produce a smooth internal surface comprising:

forming a mandrel containing a negative image of the internal geometry;

coating the mandrel with a nonferrous material which is not chemically reactive with the material from which the mandrel is formed;

capturing the mandrel in a mold which is to receive a material from which the turbine nozzle is to be formed, the material from which the turbine nozzle is to be formed not being chemically reactive with the coating;

filling the form with the material from which the turbine nozzle is to be formed and processing the material to capture the mandrel and coating in the material contained in the form; and removing the form and the mandrel from the turbine nozzle while retaining the non-ferrous material as the gas flow path of the turbine nozzle.

14. A process for making formed objects in accordance with claim 13 wherein:
the coating on the mandrel is metallic.

15. A process for making formed objects in accordance with claim 14 wherein:
the mandrel is made from a material which withstands compressive force upon solidification of the material contained within the form without damaging the mandrel.

16. A process for making formed objects in accordance with claim 15 wherein:
the mandrel is made from carbon.

17. A process for making formed objects in accordance with claim 15 wherein:
the mandrel is made from a ceramic.

18. A process for making formed objects in accordance with claim 15 wherein:
the mandrel is made from a ceramic composite.

19. A process for making formed objects in accordance with claim 15 wherein:
the mandrel is made from a soluble ceramic.

20. A process for making formed objects in accordance with claim 16 wherein:
the mandrel is machined carbon.

21. A process for making formed objects in accordance with claim 14 wherein:
the coating of the mandrel is placed by electroplating the mandrel.

22. A process for making formed objects in accordance with claim 14 wherein:
the coating of the mandrel is placed by chemical vapor deposition.

23. A process for making formed objects in accordance with claim 14 wherein:
the coating of the mandrel is placed by physical vapor deposition.

24. A process for making formed objects in accordance with claim 14 wherein:
the coating of the mandrel is placed by thermal spray deposition.

25. A process for making a casting with internal geometry without requiring machining of the internal geometry to produce a smooth internal surface comprising:
forming a mandrel containing a negative image of the internal geometry;
coating the mandrel with a nonferrous material which is not chemically reactive with the material from which the mandrel is formed;
capturing the mandrel in a mold which is to receive a molten metal from which the casting is to be cast, the molten metal from which the casting is to be cast not being chemically reactive with the coating and having a melting point below the melting point of the material of the coating;
filling the mold with molten casting metal to capture the mandrel and coating in solidified casting material contained in the mold;
removing the mold and the mandrel from the casting; and wherein
the coating on the mandrel is chosen from a metal consisting of gold, silver, platinum, palladium, iridium, rhodium, rhenium, columbium, niobium, tantalum, chromium, tungsten and molybdenum; and
the molten metal is chosen from the group consisting of stainless steel, nickel base alloys, superalloys, cobalt based alloys and aluminides.

26. A process in accordance with claim 25 wherein:
the casting is a turbine nozzle and the coating on the mandrel defines a gas flow path of the turbine nozzle.

27. A process for making a formed object with an internal geometry without requiring machining of the internal geometry to produce a smooth internal surface comprising:
forming a mandrel containing a negative image of the internal geometry;
coating the mandrel with a material which is not chemically reactive with the material from which the mandrel is formed;
capturing the mandrel in a form which is to receive a material from which the object is to be formed, the material from which the object is to be formed not being chemically reactive with the coating;
filling the form with the material from which the object is to be formed and processing the material to capture the mandrel and coating in the material contained in the form;
removing the form and the mandrel from the object; and wherein
the coating on the mandrel is chosen from a metal consisting of gold, silver, platinum, palladium, iridium, rhodium, rhenium, columbium, niobium, tantalum, chromium, tungsten and molybdenum; and
the material is formed by powder metallurgical processing.

28. A process in accordance with claim 27 wherein:
the casting is a turbine nozzle and the coating on the mandrel defines a gas flow path of the turbine nozzle.

29. A process for making a castings with an internal geometry without requiring machining of the internal geometry to produce a smooth internal surface comprising:
forming a mandrel containing a negative image of the internal geometry;
coating the mandrel with a nonferrous material which is not chemically reactive with the material from which the mandrel is formed;
capturing the mandrel in a mold which is to receive a molten metal from which the casting is to be cast, the molten metal from which the casting is to be cast not being chemically reactive with the coating and having a melting point below the melting point of the material of the coating;
filling the mold with molten casting metal to capture the mandrel and coating in solidified casting material contained in the form; and
removing the form and the mandrel from the casting while retaining the non-ferrous material as the smooth internal surface.

30. A process for making formed objects with an internal geometry with requiring machining of the internal geometry to produce a smooth internal surface comprising:
forming a mandrel containing a negative image of the internal geometry;
coating the mandrel with a nonferrous material which is not chemically reactive with the material from which the mandrel is formed;
capturing the mandrel in a form which is to receive a material from which the object is to be formed, the material from which the object is to be formed not being chemically reactive with the coating;
filling the form with the material from which the object is to be formed and processing the material to capture the mandrel and coating in the material contained in the form; and
removing the mold and the mandrel from the object while retaining the non-ferrous material as the smooth internal surface.

* * * * *